US010561283B2

(12) United States Patent
Deng et al.

(10) Patent No.: US 10,561,283 B2
(45) Date of Patent: Feb. 18, 2020

(54) PAPER TOWEL DISPENSING CABINET

(71) Applicant: Hestan Commercial Corporation, Anaheim, CA (US)

(72) Inventors: Eric Deng, Irvine, CA (US); Ray Nilssen, Fairhope, AL (US); Vicente Reyes-Aguilera, Anaheim, CA (US)

(73) Assignee: Hestan Commercial Corporation, Anaheim, CA (US)

( * ) Notice: Subject to any disclaimer, the term of this patent is extended or adjusted under 35 U.S.C. 154(b) by 204 days.

(21) Appl. No.: 15/459,651

(22) Filed: Mar. 15, 2017

(65) Prior Publication Data

US 2017/0265692 A1 Sep. 21, 2017

Related U.S. Application Data

(60) Provisional application No. 62/308,540, filed on Mar. 15, 2016.

(51) Int. Cl.
*A47K 10/22* (2006.01)
*A47K 10/16* (2006.01)
(Continued)

(52) U.S. Cl.
CPC ..... *A47K 10/22* (2013.01); *A47K 10/10* (2013.01); *A47K 10/16* (2013.01);
(Continued)

(58) Field of Classification Search
CPC ..... A47K 10/22; A47K 10/3836; A47K 10/3809; A47K 10/3827; A47K 10/40;
(Continued)

(56) References Cited

U.S. PATENT DOCUMENTS 2,487,763 A * 11/1949 Patterson ..... A47K 10/22 242/598.3
2,576,526 A * 11/1951 Marchand ..... A47K 10/22 220/477
(Continued)

FOREIGN PATENT DOCUMENTS

EP 332391 A1 * 9/1989 ..... A47K 10/3836

OTHER PUBLICATIONS

Examiner's Report issued in corresponding Canadian Patent Application No. 2,960,853 dated Jan. 24, 2018.

*Primary Examiner* — Michael R Mansen
*Assistant Examiner* — Raveen J Dias
(74) *Attorney, Agent, or Firm* — Akerman LLP

(57) ABSTRACT

A door for a towel dispensing cabinet may be pivotable over an opening of a cavity. Frameworks may extend from a face of the door and define slots for stably receiving ends of a spindle assembly onto which a towel roll may be mounted. The frameworks may also include channels through which a shaft connecting the ends of the spindle assembly may be received to allow the spindle assembly to be received deeper into the slots. Towels may be dispensed from spindle assembly when stably received within the frameworks when the door is open. The door may be closed to position the spindle assembly within the cavity and seal the opening. The spindle assembly may also be removed from the frameworks for separate use when the door is open.

19 Claims, 3 Drawing Sheets

(51) Int. Cl.

| | |
|---|---|
| ***A47K 10/38*** | (2006.01) |
| ***A47K 10/10*** | (2006.01) |
| ***A47K 10/32*** | (2006.01) |
| ***A47K 10/36*** | (2006.01) |

(52) U.S. Cl.
CPC ..... *A47K 10/3809* (2013.01); *A47K 10/3827* (2013.01); *A47K 10/3836* (2013.01); *A47K 10/32* (2013.01); *A47K 10/38* (2013.01); *A47K 2010/3233* (2013.01); *A47K 2010/3681* (2013.01)

(58) Field of Classification Search
CPC .. A47K 10/405; A47K 10/426; A47K 10/424; A47K 10/44; A47K 10/36; A47K 10/38; A47K 10/32; A47K 2010/3233; A47K 2010/3681; A47K 10/10; A47K 10/16; A47K 2010/324; B65H 75/141; B65H 75/00; B65H 75/02; B65H 49/205; B65H 49/32; B65H 35/002; B65H 35/0066; B65H 35/00; B65H 16/05; B65H 16/06; B65H 19/102; B65H 19/126; B65H 19/12; B65D 85/672; B65D 85/67
USPC ..... 312/34.24
See application file for complete search history.

(56) References Cited

U.S. PATENT DOCUMENTS

| | | | | | |
|---|---|---|---|---|---|
| 3,062,606 | A * | 11/1962 | Magrauth | A47K 5/02 | 242/598.6 |
| 3,698,548 | A * | 10/1972 | Stenzel | B65D 83/0882 | 225/48 |
| 4,444,359 | A * | 4/1984 | Butler | A47K 10/38 | 225/51 |
| 5,630,563 | A * | 5/1997 | Meisner | B65H 35/002 | 225/43 |
| 5,868,342 | A * | 2/1999 | Moody | A47K 10/38 | 242/560 |
| 6,161,796 | A * | 12/2000 | Daniels | A47K 10/3836 | 242/597.1 |
| 6,929,213 | B1 * | 8/2005 | Contreras | B65H 35/002 | 225/80 |
| 7,011,271 | B2 * | 3/2006 | Walters | A47K 10/38 | 242/596.8 |
| 9,642,503 | B1 * | 5/2017 | Troutman | A47K 10/36 | |
| 2004/0195429 | A1 * | 10/2004 | Demers | A47K 10/3836 | 242/597.7 |
| 2012/0256036 | A1 * | 10/2012 | Osborne | A47K 10/38 | 242/560 |

* cited by examiner

PAPER TOWEL DISPENSING CABINET

CROSS-REFERENCE TO RELATED APPLICATIONS

This patent application claims the benefit of the filing date under 35 U.S.C. § 119(e) to U.S. Provisional Patent Application No. 62/308,540, filed on Mar. 15, 2016, the contents of which are hereby incorporated by reference in their entirety.

TECHNICAL FIELD

The present disclosure relates to an apparatus and method for dispensing paper towels from a weather protected enclosure.

BACKGROUND

Conventional towel dispensers include dispensers having weather protected regions housing paper towels. Such dispensers typically include a sealable cabinet assembly in which a paper towel roll is mounted within a cavity of the assembly, behind a door. The configuration is set with the roll core being either horizontal or vertical so that the core may rotate as towels are removed. The sealable cabinet may be mounted outdoors in a location convenient to user engaged in preparing food, which can be very remote from dining areas. While the cook would use the roll in this location for preparation and clean up, the roll may not be convenient to diners.

SUMMARY

An improved paper towel dispenser cabinet is disclosed. The cabinet may provide a weather protected paper towel roll and dispenser enclosure that allows dispensing of the dispenser and mounted towel roll from the enclosure and facilitates use of the towel roll at multiple desired locations, including separate from the enclosure.

In one aspect, a door for stably receiving a spindle assembly onto which a roll of paper towels is mounted includes a face extending along a side of the door, a first framework, and a second framework. The first framework may include a first inner face that extends outward from the face of the door to an outer edge and that defines a first channel that extends from an open end along the outer edge toward the face of the door. A first outer face may extend outward from the face of the door to an outer edge and be spaced away from the first inner face to define a first slot therebetween. The first framework may be configured to stably receive a first end of a spindle assembly within the first slot and a first portion of a shaft that extends from the first end within the first channel when the first end of the spindle assembly is received within the first slot. The second framework may include a second inner face that extends outward from the face of the door to an outer edge and that defines a second channel that extends from an open end along the outer edge toward the face of the door. A second outer face may extend outward from the face of the door to an outer edge and be spaced away from the second inner face to define a second slot therebetween. The second framework may be configured to stably receive a second end of the spindle assembly within the second slot and a second portion of the shaft that extends from the second end within the second channel when the second end of the spindle assembly is received within the second slot.

In various embodiments, the first and second frameworks are configured to interchangeably receive the first and second ends of the spindle assembly within respective first and second slots and the first and second portions of the shaft through open ends and into respective first and second channels to stably position the spindle assembly therebetween in multiple orientations. In one embodiment, the first end of the spindle assembly comprises a base and the second end of the spindle assembly comprises a cap.

In some embodiment, the first and second channel each include a restricted end positioned inward of the open end configured to block inward movement of the shaft beyond the restricted end. In one embodiment, each of the first and second channels extends inward between respective open and restricted ends at least about half a distance between the face of the door and the respective restricted end. In a further embodiment, a width of at least one of the first or second channels tapers toward its restricted end. In another embodiment, each of the first and second channels may be defined between a forward edge and a rear edge, each edge may extend along an opposing side of the respective channel between the outer edge of the respective inner face and the restricted end of the channel. At least one of the forward edges or rear edges may extend inward toward the face of the door along a non-perpendicular path with respect to the face of the door. In one example, at least one of the forward edges extends inward toward the face of the door along a rearward directed path.

In one embodiment, the first inner face and the second inner face may extend from the face of the door parallel to each other. In a further embodiment, the first inner face and the second inner face may each extend orthogonally from the face of the door. In various embodiments, the first face may include a planar expanse of material. The first inner and outer faces and the second inner and outer faces may extend outward from the planar expanse of material.

In another aspect, a towel mounting assembly may include a housing, a spindle assembly, and a door. The housing may define a cavity and that has rim defining an opening to the cavity. The spindle assembly may include a first end, a second end, and a shaft extending between the first end and the second end. A roll of paper towels may be mounted onto the shaft and dispensed therefrom. The door may be in hinged connection with the housing and pivotable between a closed position and an open position to sealingly cover the cavity at the opening in the closed position and reveal the cavity through the opening in the open position. The door may have a first face along an interior oriented side and a second face along an exterior oriented side. The assembly may further include a first framework including a first inner face that extends outward from the first face of the door to an outer edge and that defines a first channel that extends from an open end along the outer edge toward the first face of the door. A first outer face may extend outward from the first face of the door to an outer edge and be spaced away from the first inner face to define a first slot therebetween. The first framework may be configured to stably receive the first end of the spindle assembly within the first slot and a first portion of a shaft that extends from the first end within the first channel when the first end of the spindle assembly is received within the first slot. The mounting assembly may further include a second framework including a second inner face that extends outward from the first face of the door to an outer edge and that defines a second channel that extends from an open end along the outer edge toward the first face of the door. A second outer face may extend outward from the first face of the door to an outer edge and be spaced away from the second inner face to define a second slot therebetween. The second framework may be configured to stably receive the second end of the spindle assembly within the second slot and a second portion of the shaft that extends from the second end within the second channel when the second end of the spindle assembly is received within the second slot.

In various embodiments, the first and second frameworks are configured to interchangeably receive the first and second ends of the spindle assembly within respective first and second slots and the first and second portions of the shaft through open ends and into respective first and second channels to stably position the spindle assembly therebetween in multiple orientations. In one embodiment, the first end of the spindle assembly comprises a base and the second end of the spindle assembly comprises a cap.

In some embodiment, the first and second channel each include a restricted end positioned inward of the open end configured to block inward movement of the shaft beyond the restricted end. In one embodiment, each of the first and second channels extends inward between respective open and restricted ends at least about half a distance between the first face of the door and the respective restricted end. In a further embodiment, a width of at least one of the first or second channels tapers toward its restricted end. In another embodiment, each of the first and second channels may be defined between a forward edge and a rear edge. Each edge may extend along an opposing side of the respective channel between the outer edge of the respective inner face and the restricted end of the channel. At least one of the forward edges or rear edges may extend inward toward the first face of the door along a non-perpendicular path with respect to the first face of the door. In one example, at least one of the forward edges extends inward toward the first face of the door along a rearward directed path.

In one embodiment, the first inner face and the second inner face may extend from the first face of the door parallel to each other. In a further embodiment, the first inner face and the second inner face may each extend orthogonally from to the first face of the door.

The above and other objects, effects, features, and advantages of the present invention will become more apparent from the following description of the embodiments thereof taken in conjunction with the accompanying drawings.

BRIEF DESCRIPTION OF THE DRAWINGS

Novel features of the present invention are set forth with particularity in the appended claims. However, the various embodiments of the present invention described herein, both as to organization and manner of operation, may be best understood by reference to the following description, taken in conjunction with the accompanying drawings in which:

DESCRIPTION

Figure 1:
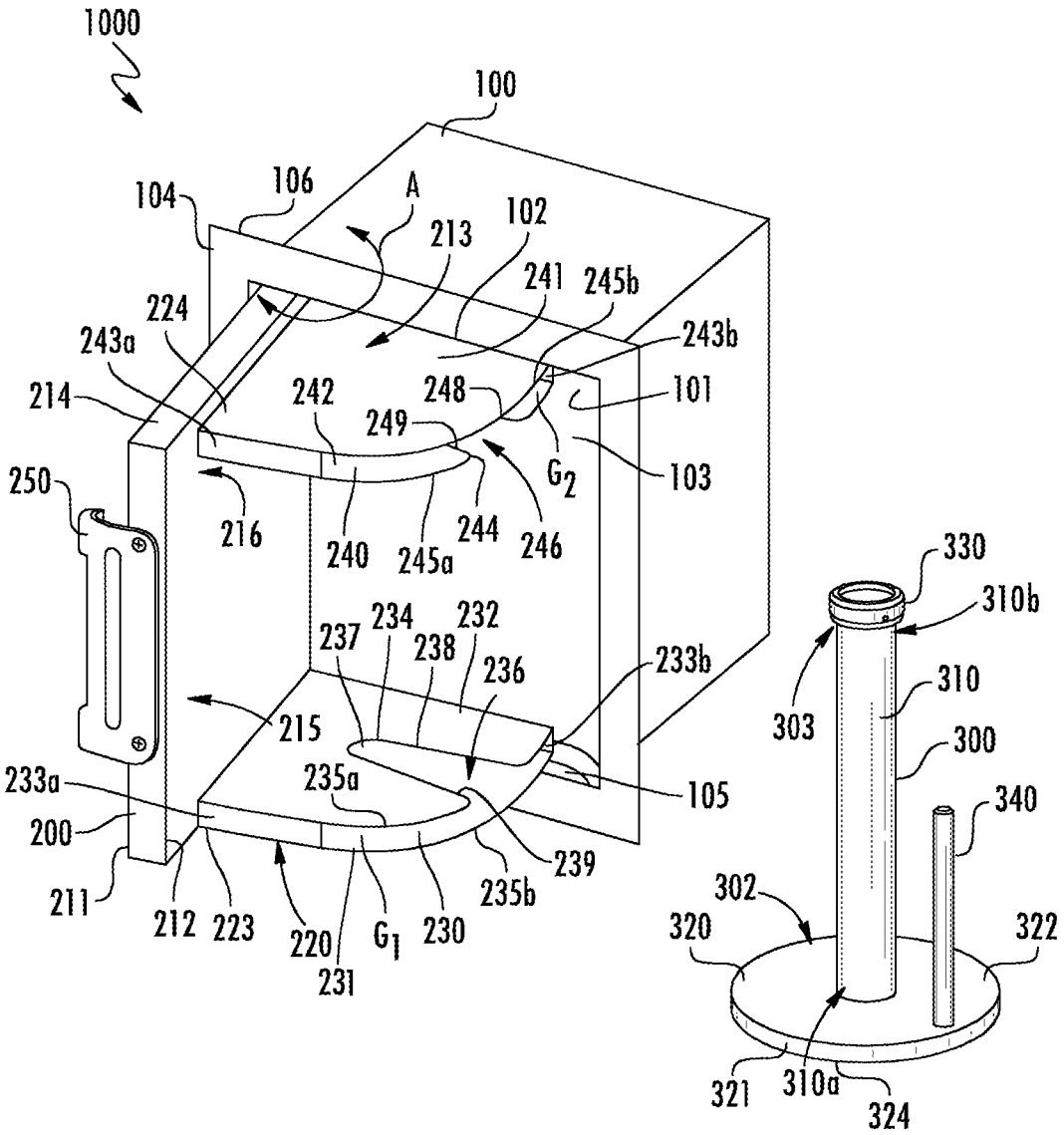
FIG. 1 is a schematic perspective view of a dispenser housing wherein a door of the cabinet is open and showing a spindle assembly removed from the interior side of the door according to various embodiments described herein.
Figure 2:
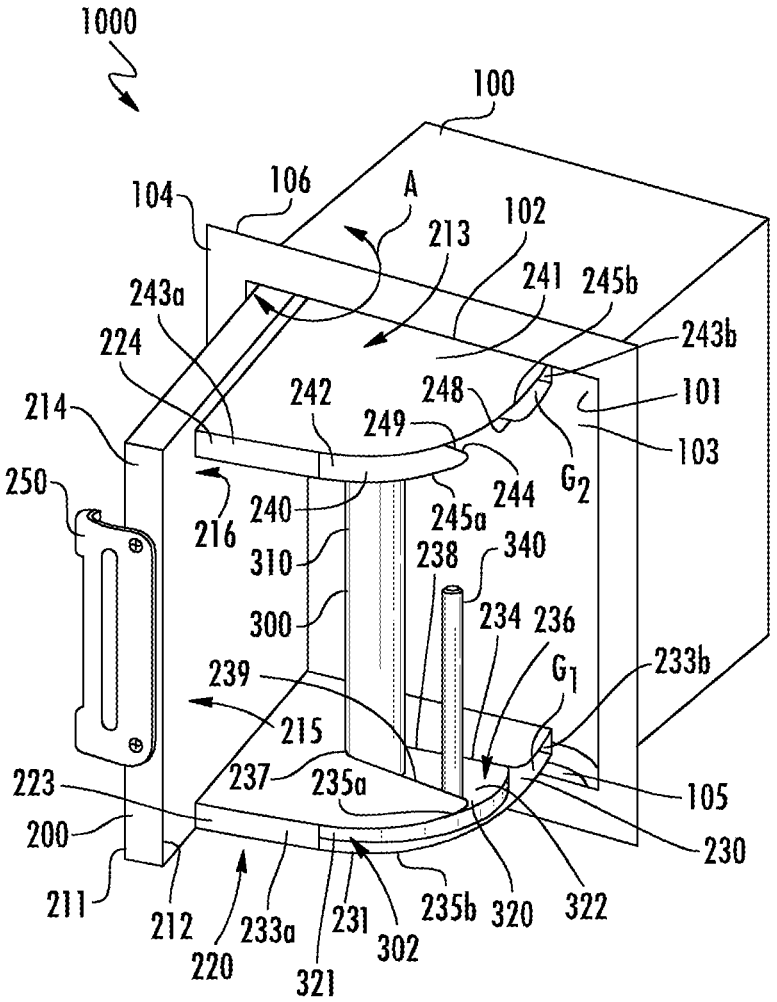
FIG. 2 is a schematic perspective view of the dispenser housing with the door open and the spindle assembly mounted inside the door according to various embodiments described herein.
Figure 3:
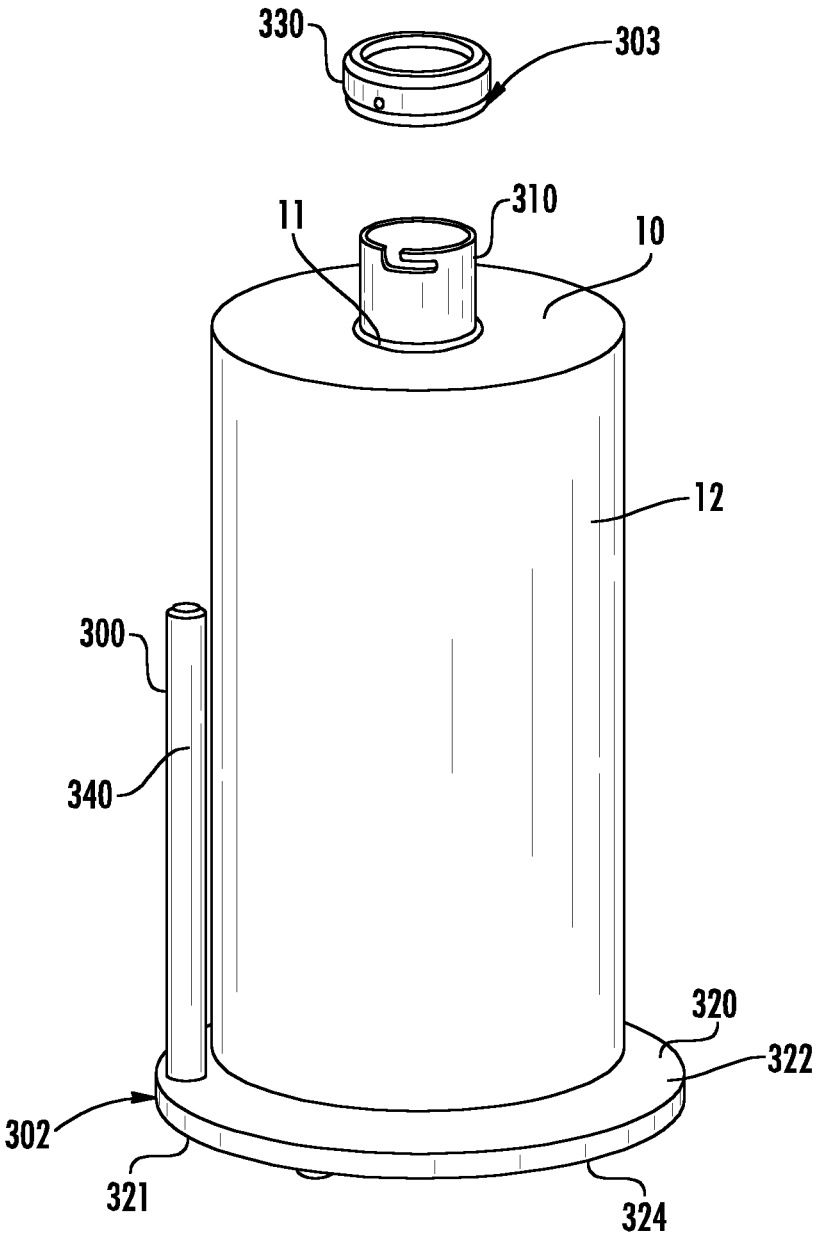
FIG. 3 is a schematic perspective view of the spindle assembly having a paper towel roll inserted onto the shaft and before a retainer cap is secured to the top of the shaft according to various embodiments described herein.

Described herein and with reference to FIGS. 1-3, wherein like reference numerals refer to like components in the various views, is an improved paper towel dispensing cabinet, generally denominated cabinet 1000.

In various embodiments, the cabinet 1000 may include a housing 100 that defines a cavity 101. The housing 100 has a rim 102 that defines an opening 103 to the cavity 101 along a side of the housing 100. A door 200 may be movably positionable over the opening 103 between an open position and a closed position. A handle 250 may be provided along an exterior oriented face 211 of the door 200 that is configured to be grasped by a user to translate the door 200 between the open and closed positions. The door 200 may include a receptacle 220 along an interior side 213 that defines slots 230, 240 for receiving a spindle assembly 300.

The cavity 101 may be dimensioned to receive the receptacle 220 and spindle assembly 300 having a towel roll 10 (see FIG. 3) mounted thereon. The towel roll 10 may be a convention paper towel roll having a hollow cylindrical core 11 and multiple layers of an absorbent material wrapped around the core 11. Strips of the paper may be separable into sheets by tearing along perforations that extend transversely across the strip primary axis.

In the closed position, the door 200 may cover the cavity 101 and sealingly interface with the housing 100 around the rim 102. From the closed position, a user may translate the door 200 to the open position to reveal the towel roll 10 mounted on the spindle assembly 300. In the open position, for example, the spindle assembly 300 and mounted roll 10 may extended outward of the cavity 101, allowing the user to grasp, pull, and tear towels off the roll 10 while the spindle assembly 300 remains stably positioned in the receptacle 220. In various embodiments, the receptacle 220 slots 230, 240 may be disposed to allow the cabinet 1000 to be mounted vertically, horizontally, or both.

The spindle assembly 300 may also be removed from the receptacle 220 for use separate from the door 200, such as counter or table top use. To dispense the towel roll 10 from the door 200, the spindle assembly 300 may be received back into the receptacle 220. For storage, the door 200 may be translated to the closed position to locate the receptacle 220, spindle assembly 300, and roll 10 within the cavity 101 to provide a weather proof enclosure.

In various embodiments, one or more hinges may pivotably mount the door 200 to the housing 100. For example, in the illustrated embodiment, the door 200 is in hinged engagement with the housing 100 such that the door 200 may be pivoted (as generally indicated by arrow A) between an open position to reveal cavity 101, as shown in FIGS. 1 & 2, and a closed position, wherein the door 200 positions over the opening 103 to cover cavity 101. One or more hinges (not visible) may be located along a side of the housing 100 adjacent to the opening 103. For example, one or more hinges may attach exterior oriented face 211 of the door 200 and an exterior face 104 extending around the rim 102 of the housing 100. In another embodiment, the door 200 may be in hinged engagement with the housing 100 via one or more hinges located within the cavity 101. For example, a hinge may attach the exterior oriented face 211, a perimeter side 214, or surface along the interior side 213 of the door 200 and an interior face 105 of rim 102 or other interior surface of the cavity 101, thereby protecting the hinges therein. In at least one embodiment, the door 200 is pivotably mounted via one or more biased hinges configured to bias the door 200 toward a closed position along all or a portion of the door 200 pivot. For example, the door 200 may be pivotably mounted to the housing 100 via one or more spring hinges or self-closing hinges. In another embodiment, instead of the door 200 being in hinged engagement with the housing 100, the door 200 may be in sliding engagement with the housing 100 such that the door 200 may slide into and out of the cavity 101 from the opening 103 between open and closed positions. For example, in one embodiment, the door 200 may be in sliding engagement with the housing 100 via wheels, tracks, rails, or grooves. Other mechanisms allowing translation of the door 200 may also be used, such as pivot pins, bearings, or gas springs.

In at least one embodiment, a latch may be provided along perimeter side 214 of the door 200 and rim 102 for securing the door 200 in the closed position. In one embodiment, a lock may also be provided together or separate from the latch.

As introduced above, the cabinet 1000 may be configured to provide a weather proof enclosure. For example, the door 200 and housing 100 may be configured to sealingly engage when the door 200 is in the closed position. In one example, interfacing surfaces of the door 200 may seal with interfacing surfaces of the rim 102 in the closed position. In various embodiments, a seal may be provided by weather stripping, elastomeric material, or other suitable sealing materials disposed along or over interfacing surfaces of one or more perimeter sides 214 of the door 200 and interior portions of the rim 102. Similarly, suitable sealing materials may be disposed along or over a perimeter of exterior oriented face 211 of the door 200 and exterior face 104 of the rim 102. When in the closed position, the seal material may be compressed, for example, between the interfacing surfaces to provide a weather tight seal. In some embodiments, the interfacing surfaces may include angled surfaces or contours structured to resist intrusion of water into the cavity 101 when the door 200 is in the closed position. Various other manners of providing a seal may also be used, such as tight or compression fitment. In any of the above or another embodiment, the door 200, housing 100, or both may be constructed of a compressible or elastomeric material along interfacing surfaces that are compressed or otherwise form a seal along the interface when the door 200 is in the closed position.

As introduced above, the door 200 may include a spindle assembly 300 receptacle 220 disposed along the interior side 213 of the door 200 that is configured to stably receive the spindle assembly 300. For example, the spindle assembly 300 may be stably received such that door 200 may be translated between open and closed positions without the spindle assembly 300 becoming dislodged from the receptacle 220. The stably received spindle assembly 300 may also be used as a towel dispenser to dispense towels without the spindle assembly 300 becoming dislodged from the receptacle 220.

In various embodiments, the receptacle 220 may include first and second frameworks 223, 224, each defining a corresponding slot 230, 240 configured to stably receive first and second ends 302, 303 of the spindle assembly 300. In the illustrated embodiment, the first end 302 includes base 320 and the second end 303 includes cap 330. The first and second slots 230, 240 are spaced apart a distance corresponding to a distance between the base 320 and the cap 330. Each slot 230, 240 is dimensioned to interchangeably receive the base 320 or the cap 330, allowing the spindle assembly 300 to be stably received in either orientation. In another embodiment, the first and second slots 230, 240 may be configured to specifically receive only one of the ends 302, 303, requiring that the spindle assembly 300 be received in the slots 230, 240 in the corresponding orientation.

The first and second frameworks 223, 224 may be disposed along the interior side 213 of the door 200. In the illustrated configuration, the interior side 213 of the door 200 includes a planar expanse of material extending along an interior oriented face 212. The first framework 223 extends from a first portion 215 of the planar expanse and positions the first slot 230 outward along the interior side 213 of the door 200. The second framework 224 extends from a second portion 216 of the planar expanse and positions the second slot 240 outward thereof along the interior side 213 of the door 200. Thus, the first and second slots 230, 240 extend outward of the first and second portions 215, 216 and inward toward the cavity 101 when the door 200 is in the closed position. The first and second frameworks 223, 224 extend outward generally perpendicular to the first and second portions 215, 216 of the planar expanse along the interior oriented side 212 of the door 200. In other embodiments, the first and second frameworks 223, 224 may extend outward of the first and second portions 215, 216 at non-perpendicular angles. As noted above, the first and second slots 230, 240 may be spaced apart a distance corresponding to ends 302, 303 or the base 320 and cap 330 thereof. In the illustrated embodiment, the first and second portions 215, 216 are located along opposite ends of the planar expanse of face 212.

The first framework 223 includes a first outer face 231 and a first inner face 232. The first outer face 231 and the first inner face 232 are spaced apart to provide gap $G_1$ of the first slot 230. The first slot 230 extends from outer edges 235*a*, 235*b* to face 212. Gap $G_1$ extends a sufficient distance to interchangeably receive both the base 320 and cap 330, allowing the spindle assembly 300 to be received into the receptacle 220 in either orientation. The first outer face 231 and first inner face 232 extend outward from the first portion 215 to outer edges 235*a*, 235*b*. The first outer face 231 and first inner face 232 extend orthogonally from to the face 212 of the door 200. The first outer face 231 and first inner face 232 may also extend outward from the first portion 215 generally in parallel to provide an opening to the first slot 230 between outer edges 235*a*, 235*b* opposed to the first portion 215 of face 212.

The first inner face 232 defines a first channel 234 configured to receive a first portion 310*a* of a shaft 310 of the spindle assembly 300. The first channel 234 extends from outer edge 235*a* of the first inner face 232 between an open end 236 and a restricted end 237. The first channel 234 may form an opening to the slot 230 along the first inner face 232 that allows an end of the spindle assembly 300 received within the slot 230 to be translated deeper into the slot 230. The first channel 234 may be defined between a rear edge 238 and a forward edge 239. Each of the edges 238, 239 extends along an opposing side of the channel 234 between the outer edge 235*a* to the restricted end 237. The open end 236 of the first channel 234 is sized to allow the shaft 310 to pass into the first channel 234. The restricted end 237 is sized to restrict the shaft 310 from passing through the channel 234 beyond the restricted end 237 when the spindle assembly 300 is received within the receptacle 220. As shown, the channel 234 is closed at the restricted end 237; however, in some embodiments the channel 234 may not be closed along the restricted end 237. In one such embodiment or in another embodiment, the restricted end 237 may include other structures positioned or sized to obstruct passage of the shaft 310 beyond the structure. In one embodiment, the restricted end 237 includes a width less than a corresponding width or diameter of the shaft 310. In various embodiments, the first channel 234 may extend inward toward the side 212 of the door 200 a distance at least about half the distance from side 212 to outer edge 235*a* or outer edge 235*b* adjacent to open end 236. In one embodiment, the restricted end 237 may be located a distance from side 212 that is greater than a thickness of the towels wrapped around the core, e.g., taken between an outer perimeter 12 of the roll and the core 11.

In the illustrated embodiment, a width of the first channel 234 taperes along a length of the first channel 234 that extends from the open end 236 to the restricted end 237. The restricted end 237 has a width sufficient to fully receive the shaft 310 adjacent to the base 320 or cap 330, but less than a corresponding width of the base 320 or cap 330, and support the shaft 310 thereon when the spindle assembly 300 is horizontally disposed within the receptacle 220.

The first channel 234 may also be configured to impede the movement, e.g., rotational, forward, rear, or lateral, of the spindle assembly 300 by blocking the movement by the post 340 when the base 320 is received within the first slot 230. For example, one or both of rear edge 238 and forward edge 239 of the channel 234 may be positioned to block movement of the post 340. In various embodiments, the first channel 234 may also be configured to prevent unintentional removal of the spindle assembly 300 from the receptacle 220 when the door 200 is in the open position. In the illustrated embodiment, the first channel 234 extends inward from the open end 236 to the restricted end 237 along a length generally directed toward face 212 of the door 200. The forward edge 239 of the first channel 234 extends toward face 212 of the door 200 along a slight rearward directed path that forms an acute angle with face 212. The rear edge 248 of the first channel 234 extends toward face 212 of the door 200 along a path forming approximately a right angle with face 212. In other embodiments, the rear and forward edges 238, 239 may extend toward face 212 of the door 200 along paths forming other combinations of acute, right, or obtuse angles with face 212.

The second framework 224 may be configured as described above with respect to first framework 223 and the various embodiments and variations thereof. As noted above, in some embodiments, the first and second frameworks 223, 224 are different and thus may define channels 234, 244 having different dimensions. In the illustrated embodiment, the first and second frameworks 223, 224 are similar. Briefly, the second framework 224 includes a second outer face 241 and a second inner face 242. The second inner face 242 is positioned to oppose the first inner face 232 providing opposing first and second slots 230, 240. In the illustrated embodiment, the first inner face 232 and second inner face 242 extend from the face 212 of the door 200 in parallel. The second outer face 241 and second inner face 242 may extend outward from the second portion 216 to outer edges 245*a*, 245*b*. The second slot 240 may extend from outer edges 245*a*, 245*b* to face 212. The second outer face 241 and second inner face 242 may also extend outward from the second portion 215 generally in parallel to provide an opening to the second slot 240 between outer edges 245*a*, 245*b* opposed to the second portion 216 of face 212. The second outer face 241 and second inner face 242 extend orthogonally from to the face 212 of the door 200. The second outer face 241 and the second inner face 242 are spaced apart to provide gap $G_2$ of the second slot 240. Gap $G_2$ extends a sufficient distance to selectively receive the base 320 or the cap 330, allowing the spindle assembly 300 to be received into the receptacle 220 in either orientation.

The second inner face 242 also defines second channel 244 configured to receive a second portion 330*b* of the shaft 310 of the spindle assembly 300. The second channel 244 extends from an outer edge 245*a* of the second inner face 242 between an open end 246 sized to allow the shaft 310 to pass into the second channel 244 and a restricted end (not visible) that is sized to restrict the shaft 310 from passing through the second channel 244 beyond the restricted end when the spindle assembly 300 is received within the receptacle 220. The second channel 244 may form an opening to the slot 240 along the second inner face 242 that allows an end of the spindle assembly 300 received within the slot 240 to be translated deeper into the slot 240.

The second channel 244 may be defined between a rear edge 248 and a forward edge 249. Each of the edges 248, 249 extends along an opposing side of the channel 244 between the outer edge 245*a* to the restricted end. In various embodiments, the second channel 244 may extend inward toward the side 212 of the door 200 a distance at least about half the distance from side 212 to outer edge 245*a* or outer edge 245*b* adjacent to open end 246. In one embodiment, the restricted end 247 may be located a distance from side 212 that is greater than a thickness of the towels wrapped around the core, e.g., taken between an outer perimeter 12 of the roll and the core 11. The rear edge 248 and forward edge 249 may define a width of the second channel 244, which tapers along its length from the open end 246 to the restricted end. The width of the second channel 244 along the restricted end is sufficient to fully receive the shaft 310 adjacent to the base 320 or cap 330, but less than a corresponding width of the base 320 or cap 330, and support the shaft 310 thereon when the spindle assembly 300 is horizontally disposed within the receptacle 220. The second framework 224 may also be configured to impede the movement of the spindle assembly 300 in a manner similar to that described above with respect to the first framework 223.

As introduced above, the door 200 may include a receptacle 220 comprising frameworks 230, 240 configured to stably receive the spindle assembly 300 for storage and dispensing. For example, the spindle assembly 300 may be stably received such that door 200 may be translated between open and closed positions without the spindle assembly 300 becoming dislodged from the frameworks 230, 240. Towels may also be dispensed while the spindle assembly 300 is stably received within the slots 230, 240 and channels 234, 244 of the frameworks 230, 240 without the spindle assembly 300 becoming dislodged from the slots 230, 240 and channels 234, 244. To remove the spindle assembly 300 from the receptacle 220, e.g., to use the spindle assembly 300 separate from the door 200, a user may lift or pull the spindle assembly 300 from the slots 230, 240 and channels 234, 244.

In some configurations, a distance between the first and second outer faces 231, 241 relative to the first and second ends 302, 303 of the spindle assembly may define allowable axial movement of the spindle assemble 300 by blocking such movement when the end 302, 303 engages the corresponding face 231. In another embodiment, one or both of channels 234, 244 may be configured to impede axial movement of the spindle assembly 300. For example, the width of the channel 234, 244 along the restricted end 237 may be less than a corresponding width of the first or second end 302, 303 of the spindle assembly 300, such as the base 320 or cap 330.

Various other configurations of frameworks 223, 224 may also be used. For example, in one embodiment, the first or second inner face 232, 242 may not include all or a portion of a rear half of the respective inner face 232, 242. For instance, the first or second inner face 232, 242 may include only a forward half or portion thereof of the inner face 232, 242. Similarly, the forward half or portion thereof may define only a forward edge 239, 249 or forward portion of the channel 234, 244. Thus, the channel 234, 244 may extend between the forward edge 239, 249 along the inner face 232, 242 and a rear side 233*b*, 243*b* of the framework 223, 224. In another embodiment, one or both of the outer face 231, 241 or inner face 232, 242 comprise rails extending outward of the interior oriented face 212 of the door 200 and defining channel 234, 244 of portion thereof. Thus, outer faces 231, 241 and inner faces 232, 242 need not necessarily be planar expanses of material that extend a forward to rear distance greater than a diameter or width of the base 320. In one embodiment, either the first or second framework 223, 224 does not include an outer face 231, 241. In another embodiment, one of the first or second frameworks 223, 224 does not include an inner face 232, 242. For example, a forward side 233*a*, 234*a* of the framework 223, 224 may be positioned to abut or retain a perimeter 321 of the base 320 when the base 320 is received with the slot 230, 240.

In further embodiments, a framework 223, 224 may include spindle assembly retaining structure. Retaining structures may be used, for example, to enhance retention of the spindle assembly 300 within the receptacle 220 during dispensing. In one such embodiment, biasing clips or latches may be positioned to engage the spindle assembly 300 and assist in retaining the spindle assembly 300. A user may apply force to overcome the bias or actuate a latch to remove the spindle assembly 300 from the receptacle.

As introduced above, a towel roll 10 may be mounted on the spindle assembly 300. The spindle assembly 300 has a first end 302 including a base 320, a shaft 310 extending upward from a first side 322 of the base 320, orthogonal from the point of attachment at the center of the base 320, and a second end 303 including a removable cap 330. In various embodiments, the base 320 may also include rubber or other non-slip feet or surfaces along a second side 324. In the illustrated embodiment, the base 320 has a circular cross-section; however, in other embodiments, the base 320 may have other cross-section shapes. The shaft 310 extends a length longer than the length of the towel roll 10 and defines a smaller outer diameter than an inner diameter of the core 11 of the towel roll 10. The cap 330 has an outer diameter larger than the inner diameter of the core 11 of the towel roll 10.

To mount or dismount the towel roll 10 from the spindle assembly 300, the cap 330 may be removed from the shaft 310 to allow the core 11 of the towel roll 10 to be inserted over the shaft 310. To retain the towel roll 10 over the shaft 310, the cap 330 may be reattached along the second end 303 of the spindle assembly 300. The spindle assembly 300 may also include a post 340. The post 340 shown in FIGS. 1-3 has a circular cross-section; however, in some embodiments, the post 340 may have other cross-section shapes. The post 340 extends from the first side 322 of the base 320 generally parallel to and in the same direction as the shaft 310. The post 340 is spaced away from the shaft 310 by a distance that is more than the thickness of the towel roll 10. Hence, when the towel roll 10 freely turns on the shaft 310, an accessible end of a towel strip extends over the post 340 to peel away from the portion tightly wrapped on the core 11. The entire spindle assembly 300 is also selectively removable from the opposing slots 230, 240 when the door 200 is in the open position, thereby, allowing the spindle assembly 300 to be located separately for dispensing towels from the towel roll 10 away from the door 200 and housing 100, e.g., on a counter or table top closer to the point of use.

Further to the above, the receptacle 220 may be configured to retain the spindle assembly 300 in any orientation. For example, in the illustrated embodiment, the spindle assembly 300 may be sufficiently retained within the receptacle 220 in both vertical and horizontal orientations as well as flipped orientation of spindle assembly 300. Accordingly, the cabinet 1000 may be vertically or horizontally mounted.

In various embodiments, the cabinet 1000 is configured to be mounted to a wall or other structure. In the illustrated embodiment, the housing 100 is configured to be flush mounted in a wall or other structure. For example, the exterior face 104 of the rim 102 includes a perimeter flange 106 configured to interface with a perimeter of an opening of a wall or other structure to recess the housing 100 therein.

In another embodiment, the cabinet 1000 may be configured to be transportable by a user. For example, the housing 100 may include a carrying handle dimensioned to be grasped by a user. The carrying handle may be the same as handle 250 or may be a different handle.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

This disclosure describes various elements, features, aspects, and advantages of various embodiments of the towel dispensing cabinet 1000 and methods thereof. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects. Any references to "various embodiments," "certain embodiments," "some embodiments," "one embodiment," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment." Furthermore, the phrases "in one such embodiment" or "in certain such embodiments," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

What is claimed is:

1. A towel mounting assembly for stably receiving a roll of paper towels, the towel mounting assembly comprising:

a spindle assembly comprising a first end, a second end, and a shaft extending between the first end and the second end, the spindle assembly configured to mount the roll of paper towels onto the shaft;

a door to removably retain the spindle assembly, the door having a face extending along a side of the door;

a first framework comprising a first inner face extending outward from the face of the door to a first outer edge and defining a first channel extending from an open end along the first outer edge toward the face of the door, and a first outer face extending outward from the face of the door to a second outer edge and spaced away from the first inner face to define a first slot therebetween, wherein the first framework is configured to stably receive the first end of the spindle assembly within the first slot and a first portion of the shaft that extends from the first end within the first channel when the first end of the spindle assembly is received within the first slot, and wherein the first end of the spindle assembly comprises a base having a perimeter that extends radially outwardly beyond the first portion of the shaft and that positions underneath the first inner face when the first end of the spindle assembly is stably received within the first framework; and a second framework comprising a second inner face extending outward from the face of the door to a third outer edge and defining a second channel extending from an open end along the third outer edge toward the face of the door, and a second outer face extending outward from the face of the door to a fourth outer edge and spaced away from the second inner face to define a second slot therebetween, wherein the second framework is configured to stably receive the second end of the spindle assembly within the second slot and a second portion of the shaft that extends from the second end within the second channel when the second end of the spindle assembly is received within the second slot, wherein the second end of the spindle assembly comprises a cap having a perimeter that extends radially outwardly beyond the second portion of the shaft and that positions above the second inner face when the second end of the spindle assembly is stably received within the second framework, wherein the perimeter of the base extends radially outwardly beyond the perimeter of the cap.

2. The towel mounting assembly of claim 1, wherein the first and second frameworks are configured to interchangeably receive the first and second ends of the spindle assembly within respective first and second slots and the first and second portions of the shaft through open ends and into respective first and second channels to stably position the spindle assembly therebetween in multiple orientations.

3. The towel mounting assembly of claim 1, wherein the first and second channels each include a restricted end positioned inward of the open end configured to block inward movement of the shaft beyond the restricted end.

4. The towel mounting assembly of claim 3, wherein each of the first and second channels extends inward between respective open and restricted ends at least about half a distance between the face of the door and the respective restricted end.

5. The towel mounting assembly of claim 4, wherein a width of at least one of the first or second channels tapers toward its restricted end.

6. The towel mounting assembly of claim 4, wherein each of the first and second channels is defined between a forward edge and a rear edge, each edge extending along an opposing side of the respective channel between the outer edge of the respective inner face and the restricted end of the channel, and wherein at least one of the forward edges or rear edges extends inward toward the face of the door along a non-perpendicular path with respect to the face of the door.

7. The towel mounting assembly of claim 6, wherein at least one of the forward edges extends inward toward the face of the door along a rearward directed path.

8. The towel mounting assembly of claim 1, wherein the first inner face and the second inner face extend from the face of the door parallel to each other.

9. The towel mounting assembly of claim 8, wherein the first inner face and the second inner face each extend orthogonally from the face of the door.

10. The towel mounting assembly of claim 1, wherein the face of the door comprises a planar expanse of material, and wherein the first inner and outer faces and the second inner and outer faces extend outward from the planar expanse of material.

11. A towel mounting assembly comprising:

a housing defining a cavity having a rim defining an opening to the cavity;

a door in hinged connection with the housing and pivotable between a closed position and an open position to sealingly cover the cavity at the opening in the closed position and reveal the cavity through the opening in the open position, the door having a first face along an interior oriented side and a second face along an exterior oriented side;

a spindle assembly comprising a first end, a second end, and a shaft extending between the first end and the second end, the spindle assembly configured to mount a roll of paper towels onto the shaft;

a first framework comprising a first inner face extending outward from the first face of the door to a first outer edge and defining a first channel extending from an open end along the first outer edge toward the first face of the door, a first outer face extending outward from the first face of the door to a second outer edge and spaced away from the first inner face to define a first slot therebetween, wherein the first framework is configured to stably receive the first end of the spindle assembly within the first slot and a first portion of the shaft that extends from the first end within the first channel when the first end of the spindle assembly is received within the first slot; and wherein the first end of the spindle assembly comprises a base having a perimeter that extends radially outwardly beyond the first portion of the shaft and that positions underneath the first inner face when the first end of the spindle assembly is stably received within the first framework; and a second framework comprising a second inner face extending outward from the first face of the door to a third outer edge and defining a second channel extending from an open end along the third outer edge toward the first face of the door, and a second outer face extending outward from the first face of the door to a fourth outer edge and spaced away from the second inner face to define a second slot therebetween, wherein the second framework is configured to stably receive the second end of the spindle assembly within the second slot and a second portion of the shaft that extends from the second end within the second channel when the second end of the spindle assembly is received within the second slot, wherein the second end of the spindle assembly comprises a cap having a perimeter that extends radially outwardly beyond the second portion of the shaft and that positions above the second inner face when the second end of the spindle assembly is stably received within the second framework, wherein the perimeter of the base extends radially outwardly beyond the perimeter of the cap, wherein, when the door is pivoted from the open position to the closed position, the first and second frameworks are translated into the cavity through the opening, wherein, when the door is pivoted from the closed position to the open position, the first and second frameworks are translated outward of the cavity.

12. The towel mounting assembly of claim 11, wherein the first and second frameworks are configured to interchangeably receive the first and second ends of the spindle assembly within respective first and second slots and the first and second portions of the shaft through open ends and into respective first and second channels to stably position the spindle assembly therebetween in multiple orientations.

13. The towel mounting assembly of claim 11, wherein the first and second channel each include a restricted end positioned inward of the open end configured to block inward movement of the shaft beyond the restricted end.

14. The towel mounting assembly of claim 13, wherein each of the first and second channels extends inward between respective open and restricted ends at least about half a distance between the first face of the door and the respective restricted end.

15. The towel mounting assembly of claim 14, wherein a width of at least one of the first or second channels tapers toward its restricted end.

16. The towel mounting assembly of claim 14, wherein each of the first and second channels is defined between a forward edge and a rear edge, each edge extending along an opposing side of the respective channel between the outer edge of the respective inner face and the restricted end of the channel, and wherein at least one of the forward edges or rear edges extends inward toward the first face of the door along a non-perpendicular path with respect to the first face of the door.

17. The towel mounting assembly of claim 16, wherein at least one of the forward edges extends inward toward the first face of the door along a rearward directed path.

18. The towel mounting assembly of claim 11, wherein the first inner face and the second inner face extend from the first face of the door parallel to each other.

19. The towel mounting assembly of claim 18, wherein the first inner face and the second inner face each extend orthogonally from to the first face of the door.

* * * * *